United States Patent [19]

Sandler

[11] 4,158,794

[45] Jun. 19, 1979

[54] DRIVE MEANS AND METHOD FOR VACUUM FLUORESCENT DISPLAY SYSTEMS

[75] Inventor: Louis M. Sandler, North Reading, Mass.

[73] Assignee: P. R. Mallory & Co. Inc., Indianapolis, Ind.

[21] Appl. No.: 924,578

[22] Filed: Jul. 14, 1978

[51] Int. Cl.[2] ..... H05B 37/00; H05B 39/00; H05B 41/00

[52] U.S. Cl. ..... 315/169.1; 315/105; 315/107

[58] Field of Search ..... 313/495, 496, 497; 315/94, 97, 105, 106, 107, 169 R, 169 TV

[56] References Cited

U.S. PATENT DOCUMENTS

| | | | |
|---|---|---|---|
| 4,045,704 | 8/1977 | Kishino et al. | 313/497 |
| 4,049,993 | 9/1977 | Kishino et al. | 313/497 |

*Primary Examiner*—Alfred E. Smith

*Assistant Examiner*—Robert E. Wise

*Attorney, Agent, or Firm*—Hoffmann, Meyer & Coles

[57] ABSTRACT

A vacuum fluorescent display system for displaying a plurality of illuminable characters includes a plurality of segmented anodes, at least one cathode filament, a plurality of control grids interposed between the anodes and the cathode filament and circuitry for controllably powering the cathode filament and for sequentially driving the control grids whereby selected segments of the anodes are sequentially illuminated and the luminous intensity of the segments of each of the anodes is substantially the same. The cathode filament is controllably powered by removing and applying heating power in response to driven and undriven states respectively of the control grids. By controlling when heating power is applied to the cathode filament the voltage along the cathode filament is the same for each anode when the selected anode segments are sequentially illuminated thereby substantially eliminating variation in luminous intensity.

15 Claims, 6 Drawing Figures

DRIVE MEANS AND METHOD FOR VACUUM FLUORESCENT DISPLAY SYSTEMS

BACKGROUND OF THE INVENTION

1. Field of the Invention

The present invention relates generally to vacuum fluorescent display systems of the type which include one or more cathode filaments, a plurality of segmented anodes situated a prescribed distance from the cathode filament, and a plurality of control grids interposed between the cathode filament and each of the segmented anodes for sequentially illuminating selected segments of the anodes to thereby display desired characters. More particularly, the present invention relates to means and method for driving the above described display system which in response to the driven and undriven states of the control grids, controls the application and removal of heating power to the cathode filament whereby the voltage drop along the filament is eliminated when the control grids are driven thereby substantially eliminating variations in luminous intensity from one anode to another.

Generally speaking, various embodiments of the improvement of the present invention either remove heating power from the cathode filament in response to a driven state of the control grids or apply heating power to the cathode filament in response to an undriven state of the control grids.

2. Description of the Prior Art

The conventional multidigit or multicharacter vacuum fluorescent display is fundamentally a plurality of triode vacuum tubes wherein each vacuum tube shares a common cathode filament and each further includes an anode (segmented) and a control grid. In a multidigit numerical display system each anode is divided into a plurality of segments which are arranged in a pattern that will allow all numerical digits (0 through 9) to be displayed by using combinations of these segments. The surfaces of the anode segments are typically coated with a fluorescent material which emits a blue green light when impacted with electrons.

When an appropriate electrical voltage is applied across the cathode filament, the filament is heated to a temperature at which electrons are thermally emitted. If a positive voltage is applied to the anode and control grid, the thermal electrons emitted from the filament are accelerated by the electric field formed by the anode segments and control grid. These electrons impact the anode after passing through the grid thereby exciting the fluorescent material causing it to emit light. When the anode or control grid voltage is negative, the electrons are repelled and no light is emitted.

If a positive voltage is applied to a combination of anode segments corresponding to a digit or character to be displayed and a positive voltage is simultaneously applied to the control grid corresponding to that anode, a desired digit or character will be displayed from the combination of lighted anode segments.

In the conventional multidigit display system each digit is sequentially illuminated by repeatedly applying a positive voltage to the appropriate control grids and selected anode segments while maintaining all other grids and anode segments at a negative voltage. The persistence of the human eye makes all of the digits appear to be continuously illuminated provided that the repetition rate of illumination of each digit is high enough.

Typically, a separate power source is required in order to heat the cathode filament. However, unlike conventional vacuum tubes, vacuum fluorescent display cathode-anode voltages are very low. Accordingly, the cathode filament voltage is not insignificantly small relative to the cathode-anode voltage as in a conventional vacuum tube. Different portions of the filament are at different potentials due to the drop in voltage experienced along the filament. Since different anode segments representing different digits utilize different portions of the filament, the cathode-anode voltage drop and the cathode-grid voltage drop vary from anode to anode or digit to digit. These voltage variations can cause intensity variations from digit to digit.

A conventional way to eliminate this variation in luminous intensity is to apply an AC voltage across the cathode filament in such a way as to time-average the variations in luminous intensity at a rate too fast for human perception. In a multidigit display system the frequency of the system drive signal and the frequency of the cathode filament signal (AC power line frequency or DC-DC converter frequency) are typically asynchronous and any beat frequencies between the two frequencies are arranged so that they are unperceptable. Many times it is desirable that the frequencies of the system drive signal and the AC power line frequency be synchronous. Typically when this condition exists, beat frequencies with perceivable amplitudes result in flicker and static intensity variations from digit to digit may also appear. Accordingly, a need exists for a drive means wherein the AC line power freuency and the system drive frequency or frequency of illumination of the digits of a vacuum fluorescent display system operate synchronously and variations in luminous intensity from digit to digit are substantially eliminated.

SUMMARY OF THE INVENTION

In accordance with the present invention in its broadest concept, there is provided a drive circuit for a vacuum fluorescent display system which includes means for controlling application of heating power to the system cathode filament during sequential illumination of the anode segments whereby variation in luminous intensity from digit to digit is substantially eliminated.

Another feature of the present invention is to provide a method of driving a vacuum fluorescent display system which includes the steps of biasing selected segments of the anodes, sequentially driving the control grids corresponding to each of the anodes, and controllably powering the cathode filament whereby the cathode filament is heated during a period when the control grids are undriven and variation in luminous intensity from digit to digit is thereby substantially eliminated.

Yet another feature of the present invention is to provide a drive circuit as described hereinabove which includes either means for removing heating power from the cathode filament when the control grids are driven or means for applying heating power to the cathode filament when the control grids are undriven.

Other features and advantages of the present invention will be apparent from the following detailed description of a preferred embodiment thereof, which description should be considered in conjunction with the accompanying drawings.

BRIEF DESCRIPTION OF THE DRAWINGS

It should be noted that corresponding reference characters indicate corresponding parts and waveforms throughout the several views of the drawings.

DESCRIPTION OF THE PREFFERED EMBODIMENT

Figure 1:
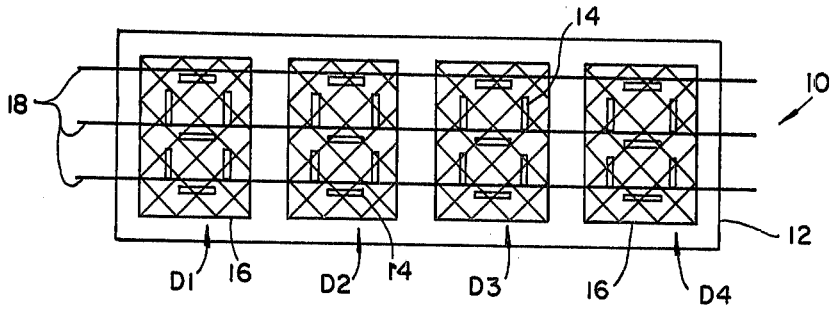
FIG. 1 is an elevation view of a conventional vacuum fluorescent display system for displaying form digits.
Figure 2:
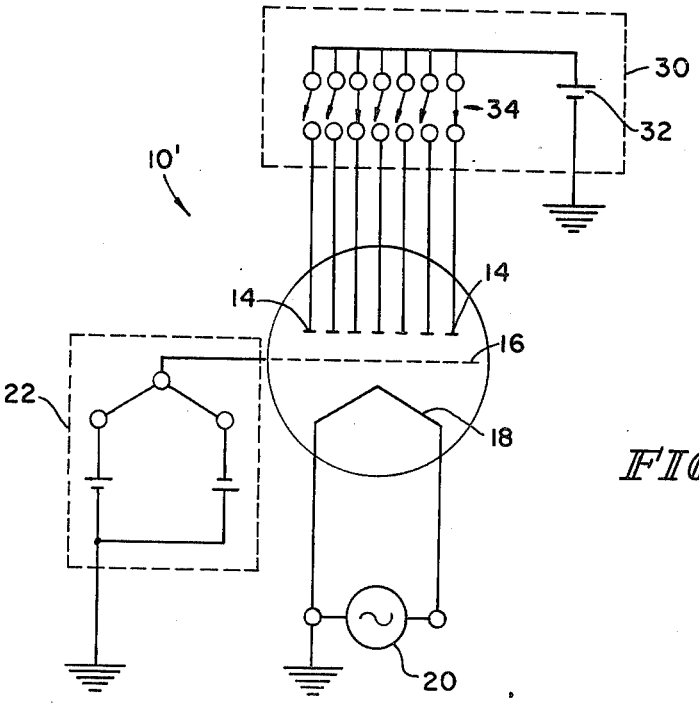
FIG. 2 is a schematic representation of a one digit display of the display system shown in FIG. 1.

Referring to the above described figures and more particularly to FIGS. 1 and 2, there is illustrated a conventional multidigit vacuum fluorescent display 10. The vacuum fluorescent display 10 shown in FIG. 1 includes four (4) digits or character displays D1, D2, D3, and D4 and essentially comprises the combination of a series of individual triode vacuum tubes 10' such as is illustrated in FIG. 2.

Each digit or character display unit D1, D2, D3 or D4 includes one or more cathode filaments 18, a control grid 16, and an anode substrate 12 including a plurality of anode segments 14 for each digit arranged in a pattern that will allow all numerical digits from zero (0) through nine (9) to be displayed by using various combinations of the segments.

As shown in the drawings, the cathode filaments 18, the control grids 16, and the anode segments 14 are all placed a prescribed distance from each other. In a multidigit display system the cathode filaments are electrically coupled in parallel to a heating power source which is typically an AC power source 20. Each similarly situated anode segment of a digit D1 is electrically coupled in parallel with all other similarly situated anode segments, of the other digits D2, D3, and D4 to a bias control element 30 which includes a DC power supply 32 and a series of switching devices 34 for biasing various selected anode segments, and each control grid is separately coupled to a DC drive supply 22 for biasing the control grid 16 associated with various anode segments 14.

Each cathode filament 18 is constructed of a fine tungston wire which is coated with a material such as barium oxide (not shown). The diameter of the filament 18 with the coating is sufficiently small that it does not interfere with the viewing of the illuminated anode segments.

Each control grid 16 comprises a thin stainless steel plate which has been etched resulting in a fine steel mesh. The mesh enables the radiation of the emitted light from the anode segments 14 to pass therethrough to the viewer. The surface of the anode segments 14 is coated with a zinc oxide based fluorescent material (not shown) which emits a blue-green light when impacted by electrons.

In operation, an electrical voltage from the AC power source 20 is applied to the cathode filament 18 whereby the cathode filament 18 is heated to a temperature in the range of 590–690 degrees centigrade. At these temperatures electrons are thermally emitted from the coating on the filament 18. When an anode segment 14 is biased positve by control element 30 and the control grid 16 is driven positive by drive supply 22 the electrons emitted from the filament are accelerated by the electric field which is formed by the positively baised anode segments 14 and the positively driven control grid 16 and are thereby caused to impact the anode segments 14. This impact excites the fluorescent material and light is emitted. When either an anode segment 14 is unbiased or a control grid 16 is undriven the electrons are repelled. Accordingly, when the control grid 16 is undriven none of the electrons reach the anode segments 14 and therefore no light is emitted.

When a combination of anode segments 14 of a digit D1, corresponding to a digit or character desired to be displayed are positively biased by means 30 and control grid 16 is simultaneously driven, the desired digit or character will be displayed from the combination of illuminated anode segments 14. The multidigit display 10 shown in FIG. 1 is accomplished by biasing appropriate anode segments 14 of each digit D1, D2, D3 and D4 and sequentially driving each control grid 16 for a short period of time.

Unlike conventional filament vacuum tubes which use anode bias voltages which are significantly greater than the magnitude of the filament voltage, the anode bias boltages of the vacuum fluorescent display 10 are very low, i.e., approximately 30 volts. Accordingly, the filament voltage in the display 10 is a significant fraction of the anode bias voltage and different portions of the filament 18 are at different potentials due to the voltage drop along the filament caused by the heating thereof. Since different digits D1, D2, D3 and D4 use different portions of the filament 18 in a multidigit system this voltage variation causes luminous intensity variation from digit to digit. Typically, this problem of variation in luminous intensity is solved by applying the AC heating power 20 to the filament 18 and driving the control grids 16 in such a manner that the variations in intensity are time averaged during a cycle of the AC power supply 20 and therefore occur at a rate too fast for perception. However, this solution does not work where it is necessary that the frequency of the heting power applied to the filament 18 from the AC power supply 20 be synchronous with the frequency of the sequential illumination of the digits.

Figure 3:
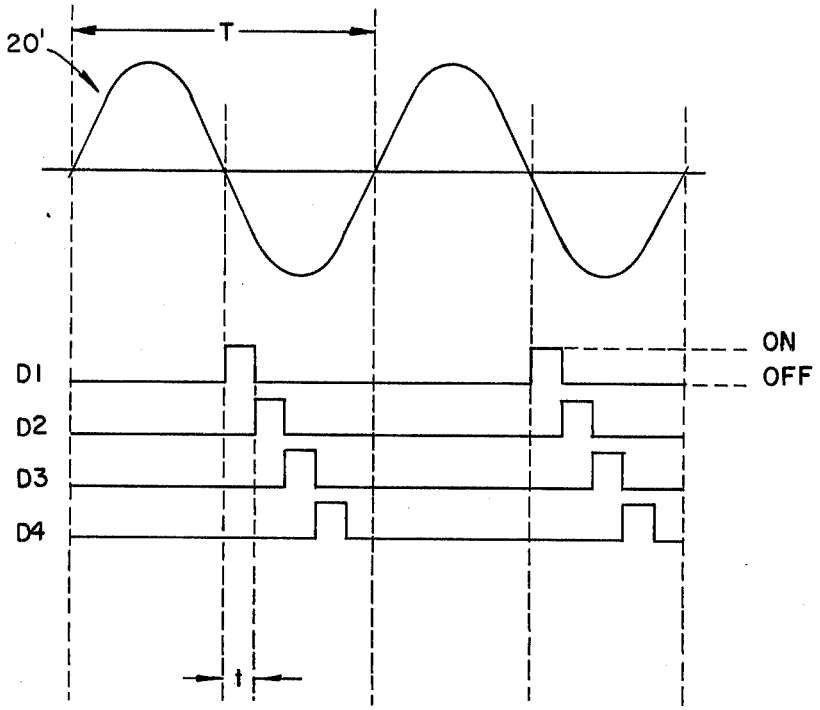
FIG. 3 is a waveform representation of the operation of the display system shown in FIG. 1.

Referring now to FIG. 3, waveforms are illustrated which are representative of a multidigit vacuum fluorescent display system wherein it is desirable that the illumination of the various digits D1, D2, D3 and D4 be synchronous with the frequency of the sequential illumination of the digits, which is typically the AC power line frequency and in most instances is the AC power source 20 for the filaments 18. The waveform 20' representing the voltage of AC power source 20 has a cycle or period T. In order to illuminate the various digits synchronously with the AC waveform 20' the frequency at which the control grids 16 are sequentially driven must be equal to the frequency of the AC waveform 20'. As shown in FIG. 3, in the multidigit system 10 each control grid 16 is driven sequentially for a time period t during which the corresponding anode segments 14 are turned on and off. Each segmented anode 14 and control grid 16 experiences a different voltage potential along the filament 18 which can ot be time averaged due to the requirement for synchronous operation with the AC waveform 20'; accordingly a luminous intensity variation occurs from digit to digit, i.e., digit D4 is brighter than digit D1 in the example shown.

Figure 4:
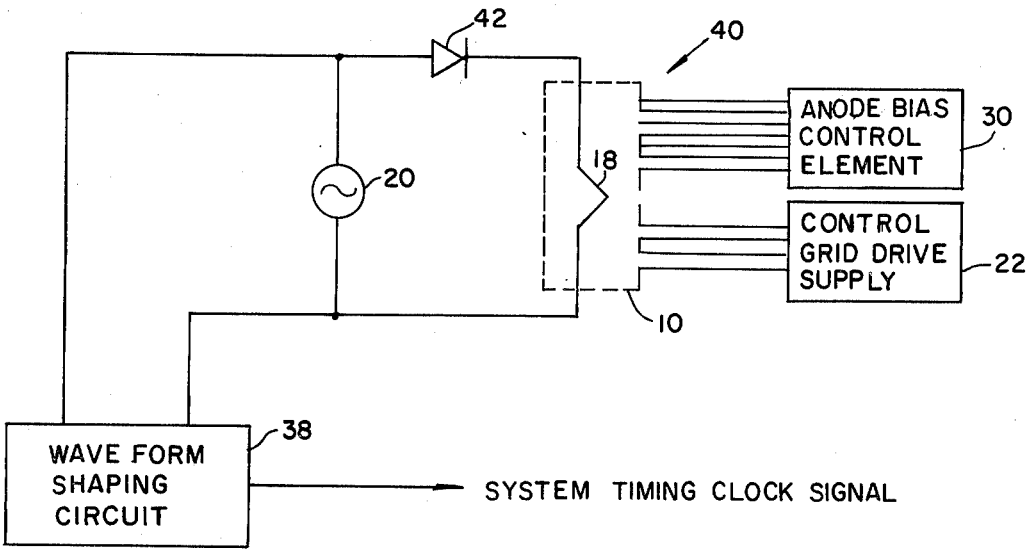
FIG. 4 is an embodiment of a drive circuit constructed in accordance with the present invention for the display system shown in FIG. 1.
Figure 5:
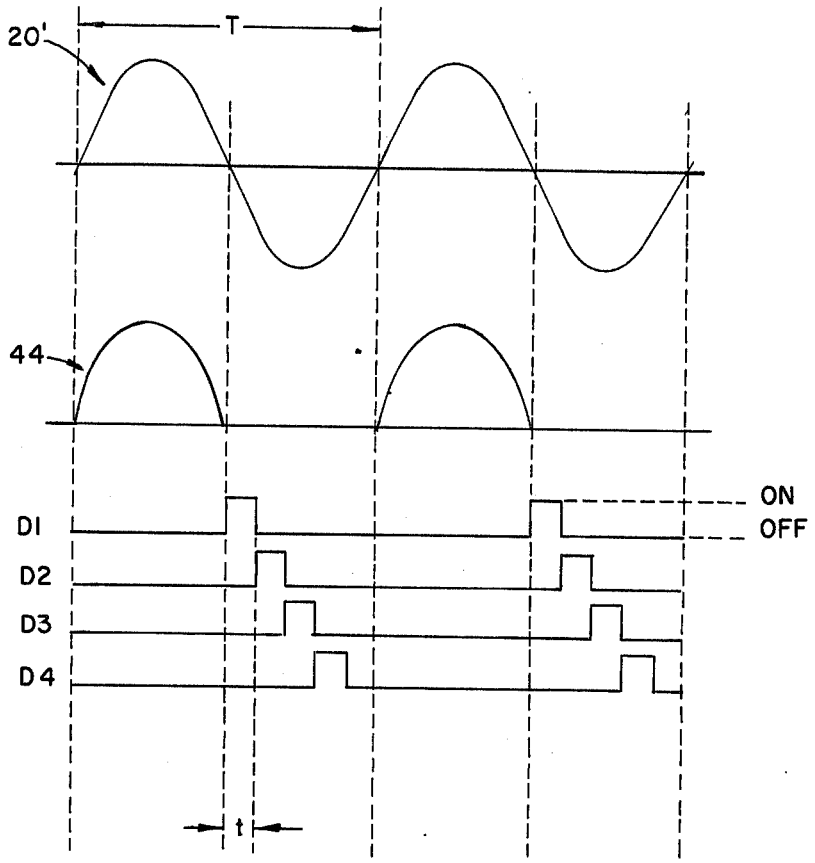
FIG. 5 is a waveform representation of the operation of the vacuum fluorescent display system shown in FIG. 1 including the drive circuit of FIG. 4.

Referring now to FIGS. 4 and 5 an embodiment of a drive circuit 40 for a multidigit vacuum fluorescent display system 10 which has its filaments 18 synchronously powered with the frequency of illumination of the digits is illustrated wherein heating power is removed from the cathode filament 18 during a period of the AC power source 20 (20') when the digits D1, D2, D3 and D4 of display system 10 are being sequentially driven. As shown, the AC power source 20 synchronously provides a system timing clock signal which is shaped by waveform shaping circuit 38 and provides heating power to the cathode filaments 18 of display system 10. By utilizing a diode 42 electrically interposed between the AC power source 20 and the cathode filaments 18 a half-cycle of the AC voltage waveform 20' is rectified (waveform 44 shown in FIG. 5). Accordingly, the control grids 16 corresponding to the digits D1, D2, D3 and D4 may be sequentially driven during this period of time when heating power is removed from the cathode filaments 18 whereby the filament voltage drop experienced in the system represented by the waveforms shown in FIG. 3 is eliminated thereby substantially eliminating variation in luminous intensity from one digit to another. When the heating power is removed during the portion of the period when the digits D1, D2, D3 and D4 are sequentially illuminated the cathodes (filaments) 18 of all of the digits D1, D2, D3 and D4 are at essentially the same electrical potential while the digits are being driven. It will be understood by those skilled in the art that FIGS. 4 and 5 are merely examples of an embodiment of the present invention and that diode 42 could be biased such that heating power would be removed from filaments 18 during the time period associated with the positive portion of the AC waveform 20' and digits D1, D2, D3 and D4 would be driven during this period of time.

Figure 6:
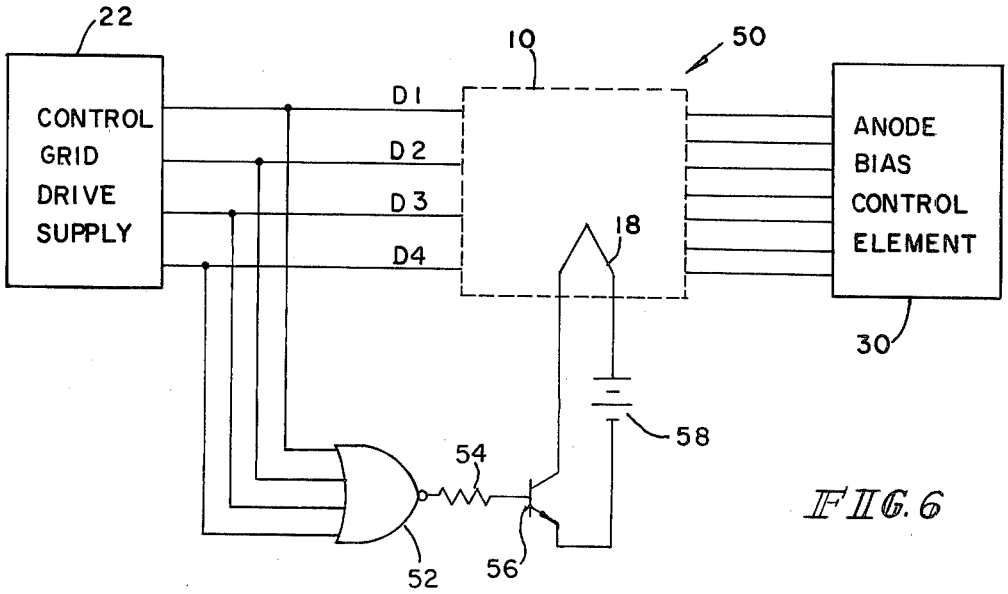
FIG. 6 is an embodiment of a drive circuit constructed in accordance with the present invention for the display system shown in FIG. 1.

Illustrated in FIG. 6 is another embodiment of the present invention which also solves the problem of luminous intensity variations when the filaments 18 are to be driven synchronously with the frequency of illumination of the digits. However, unlike the embodiment shown in FIGS. 4 and 5 the drive circuit 50 shown in FIG. 6 only applies heating power to the filaments 18 whenever no digit drive signals are being supplied by control grid drive supply 22. In drive circuit 50, when all of the outputs of control grid drive supply 22 are off or low, i.e. all of the digtis D1, D2, D3 and D4 are off, the cathode filament 18 is activated. As shown, the cathode filament 18 in this embodiment is driven by a DC power supply 58. An inverting logic gate 52 (NOR gate) has four inputs each electrically coupled to a digit output of the control grid drive supply 22 and an output which is electrically coupled through a resistor 54 to the base of a switching device 56 which in this embodiment is an NPN transistor. The transistor has its collector electrically coupled to the cathode filament 18 and its emitter electrically coupled to the negative side of the DC power supply 58.

In operation, when all of the digits D1, D2, D3 and D4 are undriven, low signals appear at each of the inputs of NOR gate 52 thereby causing its output to be high. The high output of NOR gate 52 in turn activates transistor 56 which turns on or applies heating power to the cathode filament 18. When any one of the digits D1, D2, D3 or D4 is driven, a high signal appears at the corresponding input of NOR gate 52 thereby resulting in a low output which deactivates transistor 56. Accordingly, drive circuit 50 applies heating power to the cathode filament 18 only when none of the digits D1, D2, D3 or D4 are being driven; otherwise heating power is not applied to the filament 18.

It will again be understood by those skilled in the art that a PNP transistor and an OR logic gate could be used in place of the NOR gate 52 and transistor 56 shown in FIG. 6 without departing from the essence of the embodiment illustrated and therefore it is not intended that the present invention be limited to the use of a NOR gate and an NPN transistor.

The exemplifications set out hereinabove illustrate the preferred embodiment of the invention in two forms thereof, and such exemplifications are not to be construed as limiting in any manner the scope of the invention disclosed herein.

What is claimed is:

1. A drive circuit for a vacuum display system having a plurality of sequentially illuminable elements, comprising means for controlling application of heating power to said display system during sequential illumination of said elements whereby variation in luminous intensity from one element to another is substantially eliminated.

2. The circuit as recited in claim 1 wherein said means for controlling application of heating power includes circuit means for removing heating power from said display system during sequential illumination of said elements.

3. The circuit as recited in claim 2 wherein said circuit means for removing heating power includes means for half-wave rectifying an alternating signal electrically interposed between an alternating signal source and said display system whereby heating power is removed during a half-wave portion of said alternating signal said elements are sequentially illuminated.

4. The circuit as recited in claim 1 wherein said means for controlling application of heating power includes circuit means for applying heating power to said display system upon completion of sequential illumination of said elements.

5. The circuit as recited in claim 4 wherein said circuit means for applying heating power includes at least one logic gate having its inputs electrically coupled to means for sequentially driving said elements and its output electrically coupled to a switching device which is activated when said elements are undriven.

6. In a vacuum display system for displaying a plurality of illuminable characters including at least one cathode filament, a plurality of segmented anodes, a plurality of control grids interposed between said cathode filament and said segmented anodes for sequentially illuminating at least selected segments of said anodes, and circuit means for driving said cathode filament and said control grids, the improvement comprising: means electrically coupled to said circuit means for controllably powering said cathode filament whereby said cathode filament is heated for a time period during which said control grids are undriven and when said control grids are driven variation in luminous intensity of said anode segments between anodes is substantially eliminated.

7. The improvement as recited in claim 6 wherein said cathode filament is powered synchronously with the frequency of sequential illumination of said selected segments of said anodes.

8. The improvement as recited in claim 7 wherein said means for controllably powering said cathode filament removes heating power from said cathode filament when said control grids are driven.

9. The improvement as recited in claim 7 wherein said means for controllably powering said cathode filament applies heating power to said cathode filament when said control grids are undriven.

10. The improvement as recited in claim 7 wherein said means for controllably powering said cathode filament maintains a substantially constant cathode potential for said anodes thereby eliminating potential differentials along said cathode filament.

11. A method of driving a vacuum display system for displaying a plurality of illuminable characters comprising the steps of: biasing at least selected segments of a plurality of anodes, sequentially driving a plurality of control grids each corresponding to one of said anodes thereby sequentially illuminating said anode segments, and controllably powering a cathode filament whereby said cathode filament is heated during a period when said control grids are undriven and variation in luminous intensity of said sequentially illuminated anode segments is thereby substantially eliminated.

12. The method as recited in claim 11 further including the step of powering said cathode filament synchronously with the frequency of sequential illumination of said anode segments.

13. The method as recited in claim 12 wherein said step of controllably powering said cathode filament includes the step of removing heating power from said cathode filament when said control grids are driven.

14. The method as recited in claim 12 wherein said step of controllably powering said cathode filament includes the step of applying heating power to said cathode filament when said control grids are undriven.

15. The method as recited in claim 12 wherein said step of controllably powering said cathode filament includes the step of maintaining a substantially constant cathode voltage for each anode thereby eliminating potential decreases along said cathode filament during sequential illumination of said anode segments.

* * * * *